US005939003A

United States Patent [19]

Crigler et al.

[11] Patent Number: 5,939,003

[45] Date of Patent: Aug. 17, 1999

[54] POST-TENSIONING APPARATUS AND METHOD

[75] Inventors: John Richard Crigler; Robert Duncan Lapsley, both of Raleigh, N.C.; Donald Paul Kline, Manassas, Va.; Daniel Wallace Falconer, Fairless Hills, Pa.

[73] Assignee: VSL International, Lyssach, Switzerland

[21] Appl. No.: 08/797,690

[22] Filed: Jan. 31, 1997

[51] Int. Cl.[6] ..... E04C 5/08

[52] U.S. Cl. ..... 264/228; 52/223.13; 52/223.14; 264/229

[58] Field of Search ..... 264/228, 229; 52/223.13, 223.14

[56] References Cited

U.S. PATENT DOCUMENTS

| | | | |
|---|---|---|---|
| 2,857,755 | 10/1958 | Werth | 264/228 |
| 2,950,517 | 8/1960 | Brickman | 264/228 |
| 3,422,586 | 1/1969 | Parma | 264/228 |
| 3,833,706 | 9/1974 | Edwards | 264/228 |
| 4,192,114 | 3/1980 | Jungwirth et al. . | |
| 4,449,855 | 5/1984 | Langwadt . | |
| 4,627,212 | 12/1986 | Yee . | |
| 4,680,906 | 7/1987 | Prevedini . | |
| 4,718,209 | 1/1988 | Hansen et al. . | |
| 4,799,307 | 1/1989 | Reigstad et al. | 264/228 |
| 4,821,474 | 4/1989 | Rodriguez . | |
| 5,271,199 | 12/1993 | Northern . | |
| 5,423,362 | 6/1995 | Knight | 264/228 |
| 5,540,030 | 7/1996 | Morrow | 264/228 |
| 5,749,185 | 5/1998 | Sorkin . | |

*Primary Examiner*—Karen Aftergut
*Attorney, Agent, or Firm*—Jenkins & Wilson, P.A.

[57] ABSTRACT

A post-tensioning apparatus and method including first and second body sections interconnected by an intermediate anchor head. Each body section has an end anchor head on an end opposite the intermediate anchor head and includes a tendon with a pair of strands adapted for being tensioned between the intermediate anchor head and the corresponding end anchor head of each body section. Each pair of strands is encapsulated between the intermediate anchor head and each corresponding end anchor head of each body section in a mechanically interlocked duct adapted to receive a bonding agent after tensioning of the strands. A passage is provided proximate the end anchor head of the first body section and provides a passage for insertion of bonding agent, preferably in the form of grout, into the duct of the first body section. Grout can be injected through the passage proximate the end anchor head of the first body section such that the grout can enter and fill the duct of the first body section. A tube provides a passage for grout to pass from the duct of the first body section to the duct of the second body section and around the intermediate anchor head. The ducts of both body sections can be filled with grout by passage of grout only through the passage proximate the end anchor head of the first body section and through the tube connecting the ducts of the first body section and the second body section.

28 Claims, 5 Drawing Sheets

POST-TENSIONING APPARATUS AND METHOD

TECHNICAL FIELD

The present invention relates generally to pre-stressing systems for concrete. More particularly, the present invention relates to a post-tensioning apparatus and method particularly suitable for pre-stressing concrete slabs.

BACKGROUND ART

The use of concrete as a building material is widely known as is its fundamental strength in compression and weakness in tension. It is very desirable in many construction applications to utilize materials which can withstand both compressive and tensile forces. As concrete is typically unable to resist tensile forces, some type of tensile reinforcement must be utilized with the concrete. It has been traditional to utilize deformed steel bars, commonly called "rebar", for this purpose, particularly for reinforcing concrete slabs. When combined with concrete, the rebar enables concrete to function as a construction material capable of resisting both tensile and compressive forces.

Pre-stressed concrete, which is a logical extension of the traditional rebar-reinforced concrete, utilizes reinforcement by high strength steel which is pre-stressed within the concrete thereby providing active tensile reinforcement within the concrete versus the passive reinforcement which resulted with the traditional, rebar-reinforced concrete. As is well known to those of skill in the art, such active reinforcement has been found to dramatically extend the range of applications where concrete can be used.

Pre-stressed concrete systems can be divided into two (2) basic types which are pre-tensioning pre-stressing systems and post-tensioning pre-stressing systems. In pre-tensioning systems, high strength steel strands, often referred to as "tendons", are bonded to concrete and caused to be tensioned prior to hardening of the concrete. As is known to those of skill in the art of pre-stressed concrete, it is very difficult to build continuous structures with pre-tensioned concrete.

Post-tensioning pre-stressing systems can be divided into bonded and unbonded systems. In both bonded and unbonded post-tensioning systems, a tendon comprises one or more strands, and each strand typically comprises a plurality of high-strength steel wires. The strands are positioned within a duct that is within concrete, and each strand is stressed (placed under tension) after the concrete has hardened or cured. In bonded post-tensioning systems, the duct encapsulating the strands is filled by injection with grout to bond or lock the strands in position within the duct. In unbonded post-tensioning systems, no grout is placed within the duct to surround and lock the strands in position. Rather, the strands are lubricated with grease and maintained or locked in position only by the tension resulting from the attachment of opposing ends of the strands to opposed anchorages. With unbonded post-tensioning systems, a loss of function of one or both anchorages, such as from fire, physical damage, or even corrosion, typically causes the entire pre-stressing force for each strand to be lost since the strands are not bonded to the concrete. Today, the use of supplemental reinforcing rebar is therefore required with unbonded post-tensioning systems to provide redundancy for the post-tensioning system. Quite distinguishably, bonded post-tensioning systems enable each strand to be locked or bonded continuously along its length and typically will not allow the strand pre-stressing force in each strand to be lost for its entire length because of a localized problem with the pre-stressing force of the strand, such as that caused by partial or complete loss of an anchorage.

The early construction applications for pre-stressing, post-tensioning systems utilized bonded post-tensioning systems which is considered to be the more traditional method of applying pre-stressing to concrete. In the 1960's the use of pre-stressed concrete was adapted for thin concrete slabs for use as a structural system, for example in buildings and parking garages. It was for this application that single strand unbonded post-tensioning systems, commonly referred to as "mono-strand systems" were developed wherein the single strand tendons were first coated with grease and then encapsulated with plastic. A potential disadvantage which can result from the use of mono-strand systems is possible corrosion resulting from deicing salts used during winter. This can particularly occur in parking garages where cars carry the deicing salts in with the ice and snow, and the deicing salts melt and enter the concrete through cracks, thereby allowing the deicing salts to attack and corrode the pre-stressing wires of the strand. It is generally recognized now that some deficiencies exist in such mono-strand systems, and such deficiencies can be acute at intermediate construction joints in the mono-strand systems. At such construction joints, it is necessary to strip the plastic encapsulation from the unbonded strands for the purpose of stressing and making the connection with intermediate anchorages. The intermediate construction joints also provide a logical crack or break in the concrete and have been known to provide a passage through which corrosive elements, such as salt laden water, have entered the concrete and caused corrosion of the mono-strand system.

It is therefore desirable and advantageous to utilize bonded post-tensioning systems for pre-stressing concrete used as a construction material. When utilizing bonded post-tensioning concrete systems, tendon sections are often interconnected in series by an intermediate anchorage, sometimes referred to as a coupler, which is typically used at intermediate construction joints. To provide means for inserting grout by injection into the duct of each such tendon section, existing bonded post-tensioning systems utilize a grout vent for each tendon section interconnected in series with each grout vent extending through the concrete from the duct within the concrete to an exterior area of the concrete which is usually through the top surface of the concrete slab or beam. Quite understandably, such grout vents are a tremendous hinderance for the concrete finishing operation. Furthermore, such grout vents can serve as pathways for corrosive elements, such as salt laden water, to easily access the pre-stressing ducts and grouted strands contained therein to possibly corrode the strands, particularly if proper sealing of the grout vents did not occur. Yet another problem with interconnected bonded post-tensioning systems is that the connection between the anchorages and the ducts are usually not sealed with anything other than tape or a friction-type seal, and the connection therefore will not provide an adequate water-tight seal.

In light of the existing post-tensioning systems, there remains much room for improvement in the art for an improved bonded post-tensioning apparatus and method.

DISCLOSURE OF THE INVENTION

The present invention provides a novel post-tensioning apparatus and method. The post-tensioning apparatus comprises at least two (2) post-tensioning body sections interconnected in series by an intermediate anchor head wherein each body section comprises a tendon which includes a pair of strands adapted for post-tensioning between the intermediate anchor head and opposite end anchor heads. The intermediate anchor head is part of an intermediate anchorage assembly, and the end anchor heads are part of end anchorage assemblies. One end of each pair of strands is connected to the intermediate anchor head and the opposite end of each pair of strands is connected to one of the end anchor heads. Each strand preferably comprises a plurality of twisted steel wires. Between the intermediate anchor head and each end anchor head, each pair of strands is encapsulated in a duct defined by one or more duct sections. Each duct is adapted to receive a bonding agent, preferably grout, after tensioning of each tendon such that each tendon can be bonded in position within each respective duct. In accordance with this invention, the ducts fit together to and with the intermediate and end anchorage assemblies by a grasping type fit for a strong and reliable seal rather than by primarily utilizing a friction or plug and socket type fit and seal between the ducts and the intermediate and end anchorage assemblies.

The post-tensioning apparatus further comprises passage means proximate one of the end anchor heads providing a passage for injection of grout into a duct of one of the body sections. The apparatus additionally includes transfer means providing a passage for grout to pass from the duct of one body section to the duct of another body section. In this manner, and in accordance with the method of this invention, grout can be introduced to a duct of one body section through the passage means, and the grout can pass to the duct of an adjacent body section through the transfer means. Where more than two (2) body sections are interconnected in series, each body section so interconnected can include such a transfer means, and it can be utilized as a passage for grout to pass to and through the duct of each body section.

It is therefore an object of the present invention to provide a novel post-tensioning apparatus and method.

It is another object of the present invention to provide a post-tensioning apparatus and method which enables the passage of grout therethrough to bond strands therein without requiring or using grout vents exposed to and/or through the upper or lower surfaces of a concrete structure in which the apparatus is located.

It is still a further object of the present invention to provide a post-tensioning apparatus and method utilizing a grasping type fit between the ducts and the intermediate and end anchorage assemblies for a strong and reliable seal.

Some of the objects of the invention having been stated hereinabove, other objects will become evident as the description proceeds, when taken in connection with the accompanying drawings as best described hereinbelow.

BEST MODE FOR CARRYING OUT THE INVENTION

Figure 1:
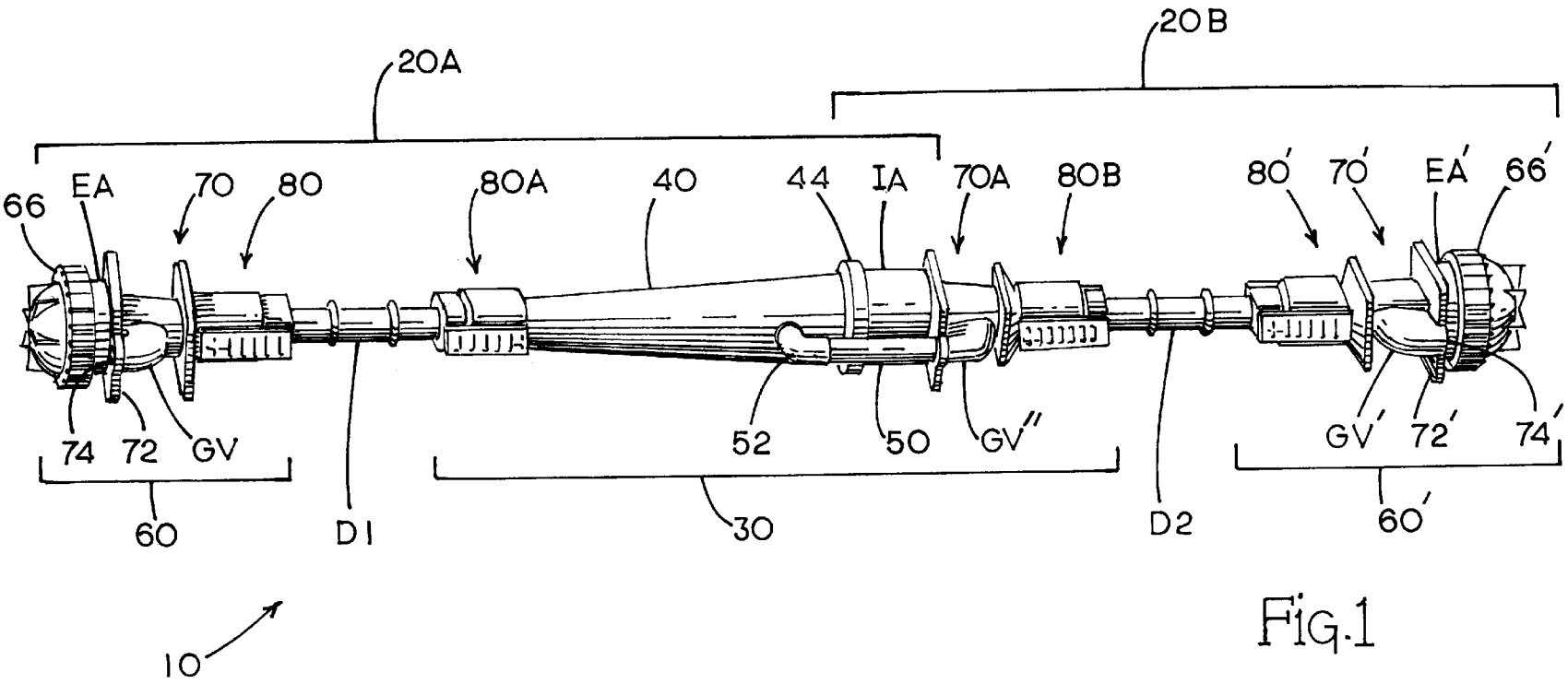
FIG. 1 of the drawings is a perspective view of one embodiment of the post-tensioning apparatus according to this invention.

In accordance with the present invention, a novel post-tensioning apparatus and method is provided. Referring to FIG. 1 of the drawings, one embodiment of a bonded, post-tensioning apparatus according to this invention is illustrated and generally designated 10. For purposes of illustration and not limitation, apparatus 10 comprises two (2) body sections 20A and 20B interconnected in series as each is linked to the other by a commonly shared intermediate anchor head IA which is part of an intermediate anchorage assembly 30. It is envisioned according to this invention, however, that a post-tensioning strand apparatus according to this invention could comprise more than two (2) body sections interconnected in series like body sections 20A and 20B wherein a plurality intermediate anchorage assemblies such as intermediate anchorage assembly 30 could be in series linking a plurality of body sections.

Figure 2:
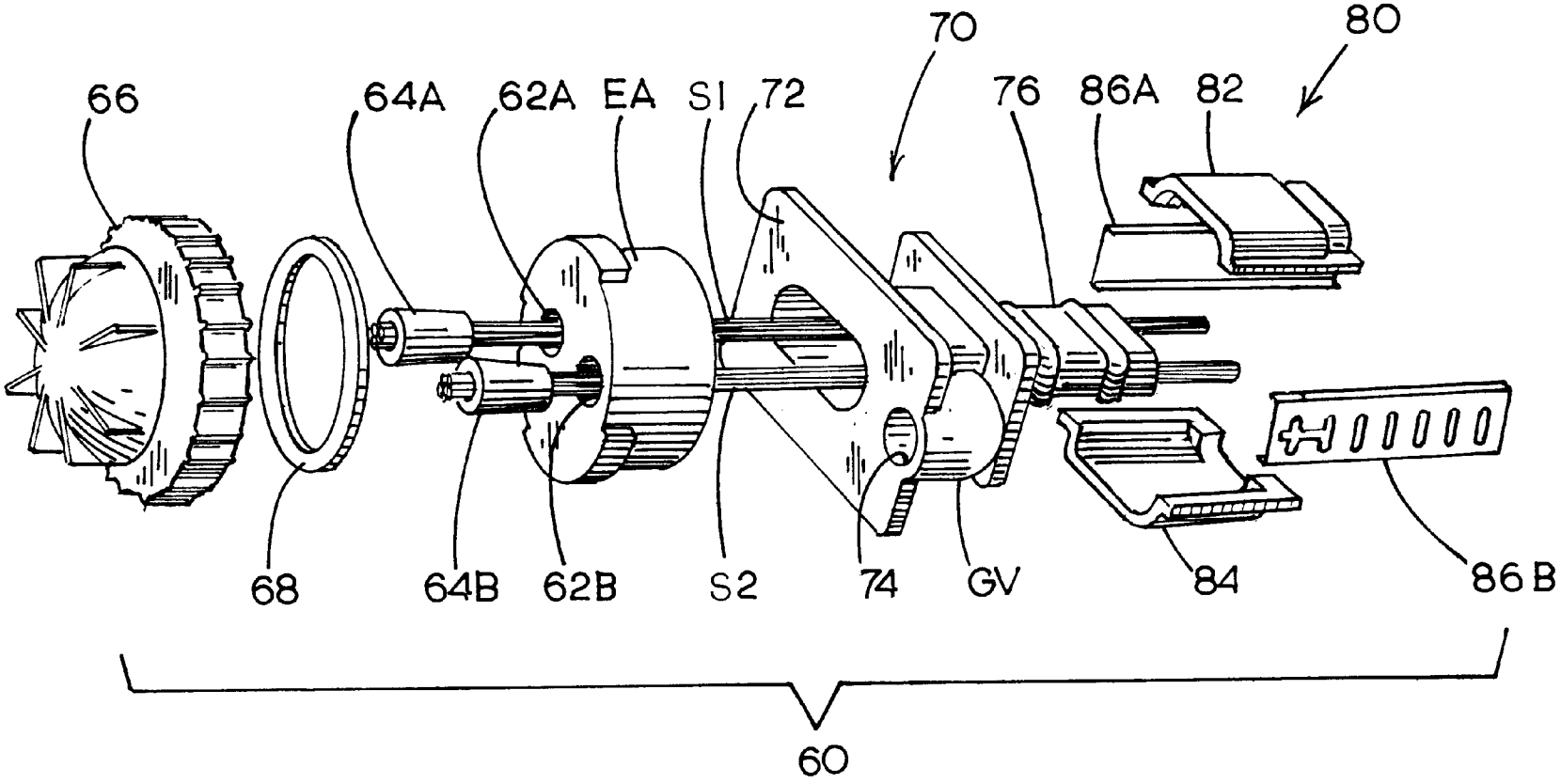
FIG. 2 of the drawings is an exploded perspective view of an end anchorage assembly of the post-tensioning apparatus according to this invention.
Figure 3:
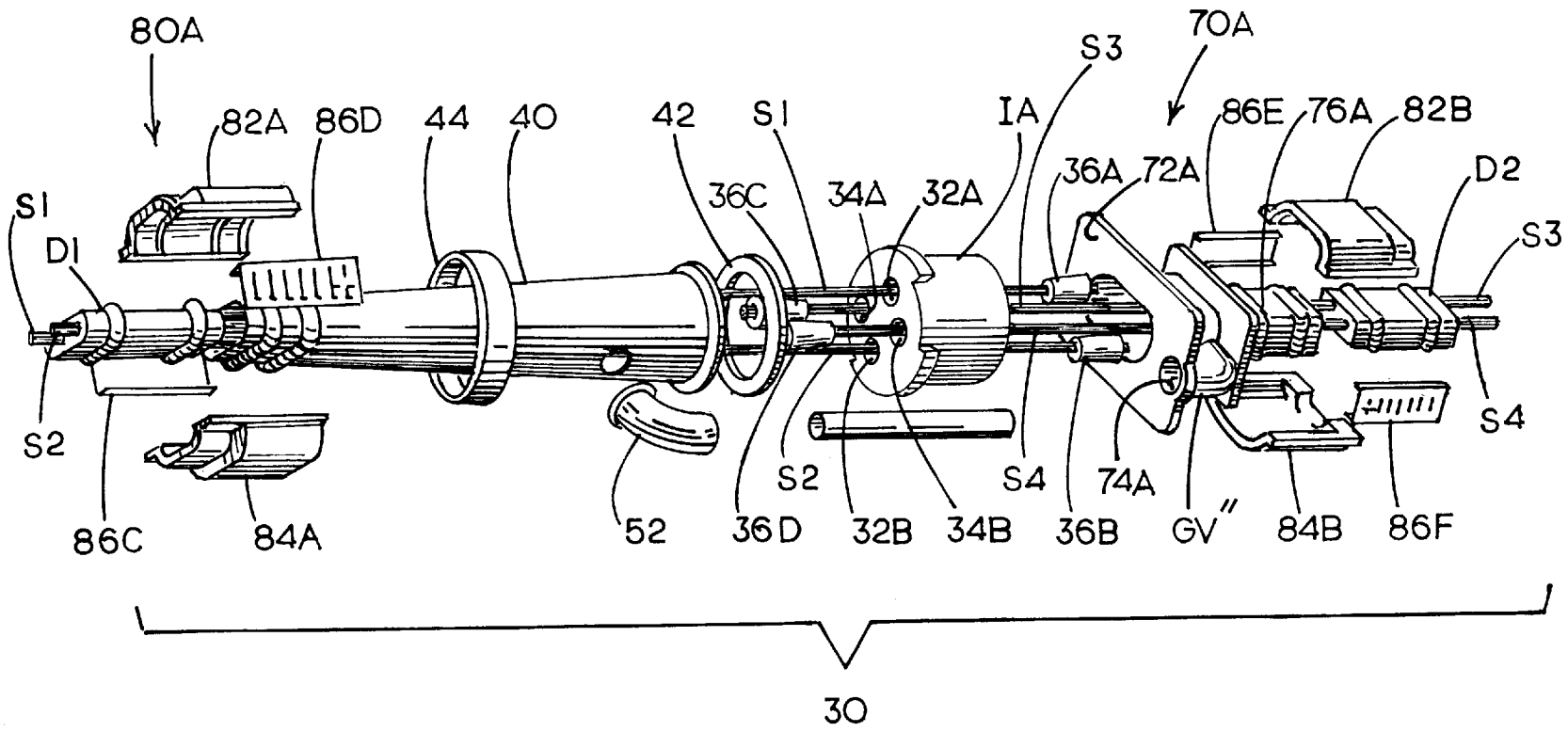
FIG. 3 of the drawings is an exploded perspective view of an intermediate anchorage assembly of the post-tensioning apparatus according to this invention.

As will be discussed with reference to other figures of drawings hereinbelow and as best illustrated in FIGS. 2 and 3, each body section 20A and 20B preferably comprises a tendon made up of a pair of strands S1,S2 and S3,S4, respectively, wherein each pair of strands is attached at one end to intermediate anchor head IA and at an opposite end to an end anchor head such as opposing end anchor heads EA and EA'. End anchor heads EA and EA' are part of end anchorage assemblies 60 and 60', respectively, which are at opposing ends of apparatus 10 with intermediate anchorage assembly 30 therebetween. Strands S1 and S2 of body section 20A extend through ribbed duct D1 between end anchorage assembly 60 and intermediate anchorage assembly 30, and strands S3 and S4 of body section 20B extend through ribbed duct D2 between intermediate anchorage assembly 30 and end anchorage assembly 60'. Ducts D1 and D2 can be of any suitable length to encapsulate strands S1,S2 and S3,S4, respectively, between opposing anchorage assemblies, and ducts D1 and D2 communicate and cooperate with the passages of other components of apparatus 10 as described hereinbelow to provide a complete duct encapsulating each pair of strands between opposing anchor heads. Although only two (2) strands for each body section are used in the preferred embodiment, it is envisioned that more than two (2) strands could be utilized for each body section. While each strand utilized in apparatus 10 preferably comprises coiled steel wires as discussed further hereinbelow, it is preferred that all of the other components of apparatus 10 be constructed of some suitable type of non-metallic material such as plastic, although it is envisioned according to this invention that intermediate anchor head IA, end anchor heads EA and EA', and the bearing plate assemblies (described hereinbelow) could be suitably constructed of metal.

FIG. 1 of the drawings illustrates end anchorage assemblies 60 and 60' in an assembled position, and FIG. 2 of the drawings illustrates an exploded view of end anchorage assembly 60 according to this invention. It will be understood therefore that end anchorage assemblies 60 and 60' are of identical construction and structure. Referring to FIGS. 1 and 2, end anchorage assemblies 60 and 60' therefore include end anchor heads EA and EA', respectively, as discussed hereinabove. Each end anchor head EA and EA' is adapted for attachment to a pair of strands S1,S2 and S3,S4, respectively, thereto such that each pair of strands can be fixedly held at one end thereof in place through an end anchor head. With specific reference to FIG. 2, end anchor head EA defines a pair of preferably at least substantially cone-shaped passages 62A and 62B therethrough which open to opposing ends of end anchor head EA. The openings to passages 62A and 62B on the end of end anchor head EA which are closest to an end of apparatus 10 are preferably of greater diameter than the openings to passages 62A and 62B on an opposite end of end anchor head EA. In this manner, cone-shaped members 64A and 64B, with strands S1 and S2, respectively, extending therethrough, can matingly engage passages 62A and 62B, respectively, to hold in place one end of strands S1 and S2, respectively. As illustrated in FIG. 1, end caps 66 and 66' are fitted over and secured to an end of end anchor heads EA and EA', respectively, so that end caps 66 and 66' completely cover and protect the passages of each end anchor head as well as the strands therein. A gasket 68, as shown in FIG. 2, can be used between end cap 66 end anchor head EA so that an at least substantially fluid-tight seal is provided when end cap 66 is secured to end anchor head EA.

End anchorage assemblies 60 and 60' include bearing plate assemblies generally designated 70 and 70', respectively, each of which defines a passage for extension of a pair of strands therethrough and forms a bearing plate 72 and 72', respectively, on one end and a ribbed duct section on an opposite end, such as duct section 76 of bearing plate assembly 70. Bearing plates 72 and 72' can be secured in an at least substantially fluid-type manner to an end of end anchor heads EA and EA', respectively, opposite end caps 66 and 66', respectively. It is preferred that bearing plates 72 and 72' be of a slim design so that each will easily fit in a concrete slab of approximately 140 mm (5.5 inches). Duct section 76 and the duct section of bearing plate assembly 72' (not shown) are adapted to engage and interconnect with ducts D1 and D2, respectively, in an at least substantially fluid-tight manner.

Bearing plate assemblies 70 and 70' also define passage means shown in the preferred embodiment as grout vents GV and GV', respectively, for passage of a bonding agent, particularly grout, through openings 74 and 74', respectively, thereof in order for the grout to pass through each bearing plate assembly and come into contact with the pair of strands passing therethrough. Although grout vents GV and GV' are shown as preferably located on one side of bearing plate assemblies 70 and 70', respectively, it can be appreciated that they could be otherwise positioned. The inside of grout vents GV and GV' at openings 74 and 74', respectively, are threaded for threadably engaging a plug (not shown) or even an extension tube (not shown), as discussed further hereinbelow.

Half-shell assemblies generally designated 80 and 80' in FIG. 1 are attached to and over ribbed ducts D1 and D2, respectively, and to and over ribbed duct section 76 of bearing plate assembly 70 and ribbed duct section 76' (not shown) of bearing plate assembly 70', respectively. Half-shell assemblies 80 and 80' are preferably attached to and over the duct sections so that an at least substantially fluid-tight seal is provided between half-shell assemblies 80 and 80' and bearing plate assemblies 70 and 70', respectively. Ducts D1 and D2 (and bearing plate assemblies 70 and 70') are grasped by the fittings of half shell assemblies 80 and 80' such that the ribs of ducts D1 and D2 as well as the ribs of duct sections 76 and 76' cannot slide past half-shell assemblies 80 and 80', respectively, in order to prevent ducts D1 and D2 and duct sections 76 and 76', respectively, from sliding apart from one another. In this manner, ducts D1 and D2 and duct sections 76 and 76', respectively, are advantageously mechanically fittingly interlocked together rather than relying primarily on a mere friction or slip type plug and socket seal. This advantage is also provided by the other half-shell assemblies of this invention described further hereinbelow.

Using FIG. 2 as an example of the structure of each half-shell assembly 80 and 80', half-shell assembly 80 is shown in FIG. 2 of the drawings in an exploded illustration wherein half-shell assembly 80 comprises an upper section 82 and a lower section 84 adapted to fit together over and around extended portions of ribbed duct section 76 and ribbed duct D1 at the intersection thereof. Clips 86A and 86B are also a part of half-shell assembly 80 and are each adapted to fittingly attach over the intersection of upper section 82 and lower section 84 as clips 86A and 86B are utilized to maintain half-shell assembly 80 in its assembled form, as best illustrated in FIG. 1.

Intermediate anchorage assembly 30 is positioned between end anchorage assemblies 60 and 60', and as discussed hereinabove, includes intermediate anchor head IA which is shared by both body sections 20A and 20B of apparatus 10. FIG. 1 illustrates intermediate anchorage assembly 30 in its assembled form in place as a part of apparatus 10 while FIG. 3 of the drawings provides an exploded illustration of intermediate anchorage assembly 30. As at least partially illustrated in FIG. 3, intermediate anchor head IA defines two (2) pairs of passages therethrough which are referred to as passages 32A and 32B and passages 34A and 34B. Each of such passages is adapted for engaging and holding in place a cone-shaped member 36A, 36B, 36C, and 36D, respectively, therein with each cone-shaped member defining a passage through which an end of a strand passes so that it can be fixedly maintained within intermediate anchor head IA. Specifically, an end of both strands S1 and S2 of body section 20A is positioned through members 36A and 36B, respectively, for fitting into passages 32A and 32B, respectively, of intermediate anchor head IA. Similarly, an end of both strands S3 and S4 of body section 20B is positioned through members 36C and 36D, respectively, for fitting into passages 34A and 34B, respectively, of intermediate anchor head IA. Intermediate anchor head IA therefore serves as an anchor head for an end of strands S1 and S2 of body section 20A as well as for strands S3 and S4 of body section 20B.

Referring to both FIGS. 1 and 3, intermediate anchorage assembly 30 includes a trumpet 40 which can be fixedly attached to end of intermediate anchor head IA wherein a gasket 42 can be utilized between trumpet 40 and intermediate anchor head IA to provide an at least substantially fluid-tight seal between trumpet 40 and intermediate anchor head IA. A locking ring 44 can be used to secure trumpet 40 to intermediate anchor head IA. Trumpet 40 defines an inner area or passage therethrough used for encapsulating strands S1 and S2 of body section 20A, and trumpet 40 decreases in diameter from its attachment to intermediate anchor head IA to an opposite ribbed end of trumpet 40 adapted for suitably fitting with and end of ribbed duct D1. At the end of trumpet 40 opposite the connection of trumpet 40 to intermediate anchor head IA, a half-shell assembly generally designated 80A is fitted over and connects and protects the intersection of the ribbed end of trumpet 40 with duct D1 through which strands S1 and S2 of body section 20A pass. Half-shell assembly 80A, identical to half-shell assemblies 80 and 80' of end anchorage assemblies 60 and 60', respectively, comprises an upper section 82A and a lower section 84A adapted to fit together over an end of ribbed duct D1 and the ribbed end of trumpet 48 and be maintained in such fitted position by opposing clips 86C and 86D. As described above with reference to half-shell assemblies 80 and 80' of end anchorage assemblies 60 and 60', half-shell assembly 80A prevents sliding apart of duct D1 and trumpet 40 by fitting over and preventing sliding of the ribs of duct D1 and of the end of trumpet 40.

On an end of intermediate anchor head IA opposite trumpet 40, bearing plate assembly generally designated 70A is positioned and adapted for fitting securely to intermediate anchor head IA. Bearing plate assembly 70A can be of identical construction and structure as the bearing plate assemblies of the end anchorage assemblies and therefore defines a bearing plate 72A and a grout vent GV" for passage of grout therethrough. The end of bearing plate assembly 70A opposite bearing plate 72A, like bearing plate assemblies 70 and 70' of end anchorage assemblies 60 and 60', respectively, forms a ribbed duct section 76A through which strands S3 and S4 of body section 20B can extend. Duct section 76A can be connected to ribbed duct D2 so that strands S3 and S4 passing through duct section 80A can continue passing therefrom and into duct D2 such that strands S3 and S4 are protected and not exposed. Another half-shell assembly generally designated 80B can be fitted over and connect and protect the intersection of duct section 76A and duct D2 whereby an at least substantially fluid-tight seal can be provided between half-shell assembly 80B and both bearing plate assembly 70A and duct D2. Like the other half-shell assemblies of apparatus 10, half-shell assembly 80B comprises upper section 82B and lower section 84B which are adapted to be fitted together where they can be maintained in such fitted relationship by opposing clips 86E and 86F. As described above with reference the other half-shell assemblies, half-shell assembly 80B prevents sliding apart of duct D2 and duct section 76A by fitting over and preventing sliding of the ribs of duct D2 and of duct section 76A.

Intermediate anchorage assembly 30 additionally comprises transfer means providing a passage for communication between trumpet 40 and grout vent GV" of bearing plate assembly 70A around intermediate anchor head IA. Such transfer means is illustrated in FIGS. 1 and 3 of the drawings in its preferred embodiment as a grout tube 50 extending from its fluid-tight attachment with trumpet 40 around intermediate anchor head IA and to grout vent GV" where tube 50 is attached and connected thereto in a fluid-tight manner. One or more adjoining sections, such as elbow section 52 can be attached to tube 50 and can be threadably fitted thereto. Tube 50 therefore provides an open passage through which grout from within trumpet 40 around strands S1 and S2 can pass around intermediate anchor head IA into grout vent GV" and to the inner passage of bearing plate assembly 70A to surround strands S3 and S4. In the preferred embodiment, tube 50 is constructed of plastic. It is envisioned according to the present invention that a plurality of grout tubes as described herein could be utilized to provide passages for grout to pass around a single intermediate anchor utilized.

Figure 4:
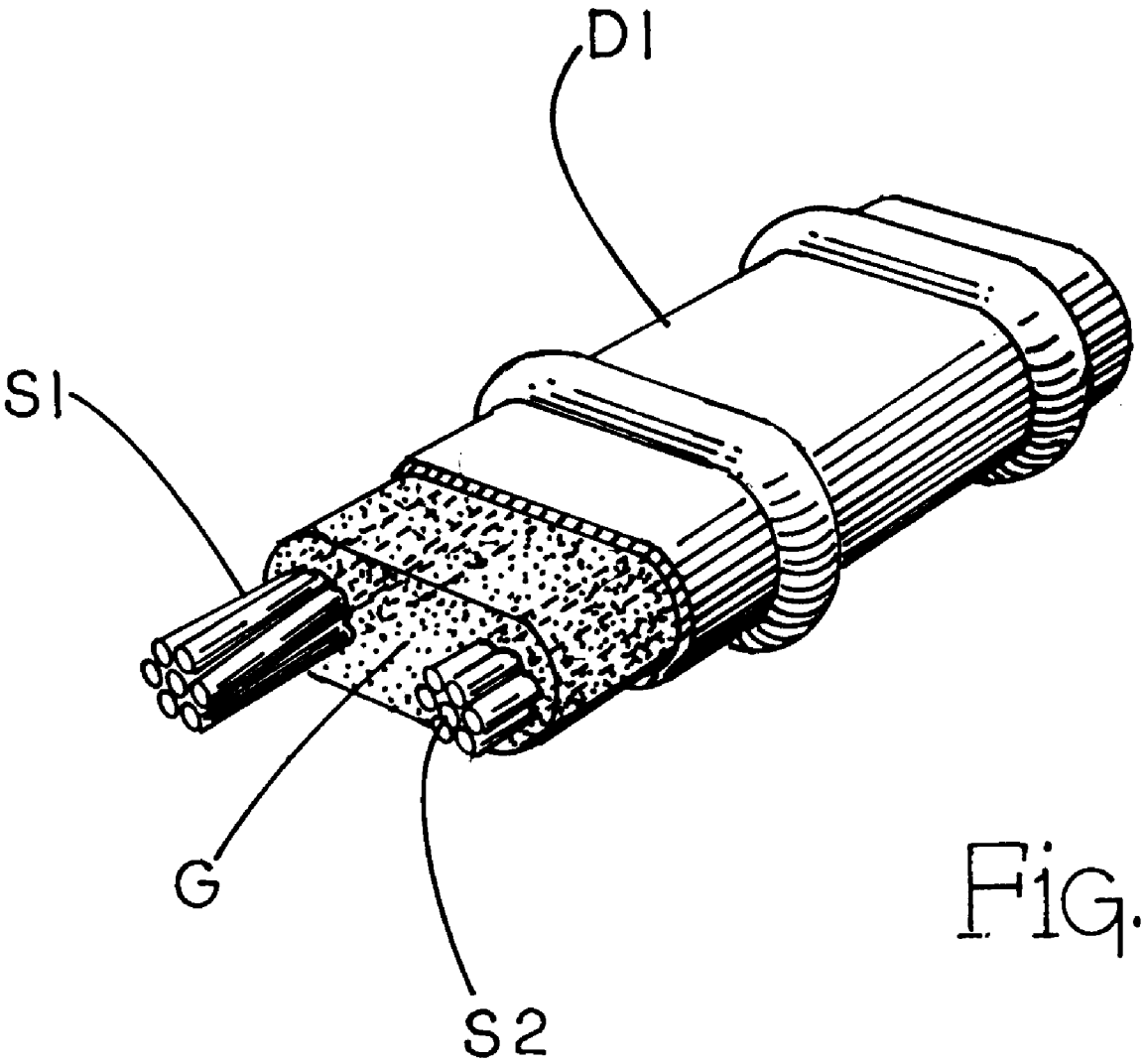
FIG. 4 of the drawings is an isolated partial cutaway perspective view of a portion of a pair of strands encapsulated and bonded by grout within a duct.

FIG. 4 of the drawings provides a better illustration of a pair of strands encapsulated within a ribbed duct according to the present invention. For purposes of illustration, strands S1 and S2 and duct D1 are shown in FIG. 4 although it can be readily understood in accordance herewith that ducts D1 and D2 of body sections 20A and 20B, respectively, can be of identical construction and structure and identically encapsulate strands S1,S2 and S3,S4, respectively. FIG. 4 illustrates strands S1 and S2 positioned in a parallel and spaced-apart relationship within plastic duct D1 wherein strands S1 and S2 are bonded in such position by grout G, which preferably is a high-performance grout suitable for industrial use in bonding the strands of apparatus 10. FIG. 4 also best illustrates strands S1 and S2 in their preferred embodiment as comprising a plurality of seven (7) twisted steel wires.

Figure 5:
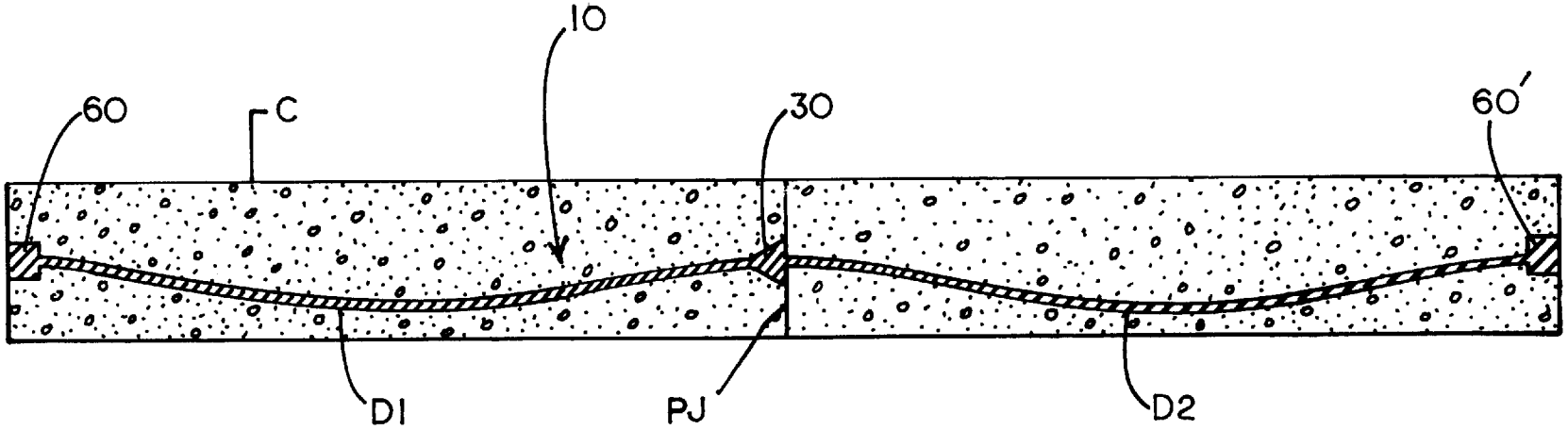
FIG. 5 of the drawings is a schematic illustration of one embodiment of the post-tensioning apparatus according to this invention within adjoining concrete slabs.

While it can be appreciated that apparatus 10 could be of any practically suitable size for reinforcing concrete structures of various sizes and shapes, apparatus 10 is preferably of a size particularly suitable for providing reinforcement for concrete slabs such as those typically used in constructing parking garages and other structures. In FIG. 5 of the drawings, a schematic illustration of an embodiment of apparatus 10 within concrete slab C is provided as apparatus 10 can be completely surrounded by concrete slab C except for opposing ends thereof which are exposed through the surface of opposing ends of concrete slab C and are used during insertion of grout into apparatus 10 as described hereinabove. It is, however, envisioned that apparatus 10 could be surrounded by and extend through a plurality of concrete slabs fitted or attached together in series while still only exposing opposing ends of apparatus 10.

As shown in FIG. 5, apparatus 10, again generally designated, is curved along its length within concrete slab C as such a curved form is preferred due to the strength and support advantages it provides as will be recognized by those of skill in the art of post-tensioning apparatuses. End anchorage assemblies 60 and 60' are schematically illustrated on opposing ends of concrete slab C with intermediate anchorage assembly 30 positioned therebetween. A pour juncture line PJ is illustrated at intermediate anchorage assembly 30 as is common for its location at the juncture of adjoining tendons or body sections. As will be appreciated by those of skill in the art, a break in the formation of concrete slab C could exist at any practically suitable place along the length thereof, and additionally, several distinct concrete slabs could be joined or formed in an abutting arrangement as desired to surround apparatus 10. Ducts D1 and D2, respectively, thereof are schematically illustrated with lengths comparatively much longer than the lengths of end anchorage assemblies 60,60' and intermediate anchorage assembly 30 as can often be the case with apparatus 10.

From the various figures of drawings and especially the illustration of FIG. 1 of apparatus 10 in its assembled form, it can therefore be readily understood that the transfer means for transferring grout around intermediate anchor head IA, which transferring means includes tube 50 and elbow section 52, can be completely surrounded within concrete when utilizing apparatus 10. It can also be understood that the pair of strands of each tendon and body section are fully encapsulated to provide a protective cover therefor from one end of apparatus 10 to the other end of apparatus 10. In this manner and when apparatus 10 is utilized for its design purpose within concrete as a post-tensioning apparatus, all strands within apparatus 10 can be shielded and protected from potential corrosive elements such as, for example, salt laden water or other materials typically utilized for treating roads and/or parking decks during cold months. Each pair of strands of each tendon is therefore surrounded and encapsulated between opposing anchor heads within a duct made up of one or more components or sections, as described hereinabove, wherein the area within which each pair of strands is encapsulated between an end anchor head and an intermediate anchor head can vary in size. For example, the inner area defined by trumpet 40 of intermediate anchorage assembly 30 through which strands S1 and S2 extend can be more expansive than other passages through which strands S1 and S2 extend, such as the passages of bearing plate assembly 70A and duct D1. The passages for extension of strands therethrough which are defined by the components of each body section encapsulating the strands are not closed off from one another, but rather are in open communication with one another such that they can be completely filled by grout to fully surround each pair of strands with grout between the intermediate anchorage assembly and the end anchorage assembly.

After strands S1, S2, S3, and S4 of apparatus 10 are in place, they can be stressed or tensioned, and they will then typically be grouted as soon as possible after approval of the stressing operation to bond the stressed strands in place. As will be readily apparent to those of skill in the art, grout can be introduced by injection to apparatus 10 through an open or unplugged grout vent at one end thereof, such as grout vent GV of end anchorage assembly 60. An extension tube can be attached to grout vent GV and extend to near, at, or even beyond the outer end surface of the concrete for utilization as desired in inserting grout into grout vent GV. The grout introduced through grout vent GV will completely fill the duct between end anchor head EA and intermediate anchor head IA, which comprises duct D1, the inner passage or duct defined by bearing plate assembly 70, and the inner passage or duct defined by trumpet 40, to completely surround strands S1 and S2 extending therebetween. As the grout nears intermediate anchor head IA, the grout cannot pass therethrough, and the grout therefore will exit trumpet 40 and enter and pass through grout tube 50 to pass around intermediate anchor head IA and into and through grout vent GV" to enter the duct of body section 20B, which comprises duct D2 and the passages or ducts defined by bearing plate assemblies 70A and 70'. In this manner, the grout will surround strands S3 and S4 within the duct of adjoining body section 20B between intermediate anchor head IA and end anchor head EA'. It can therefore be appreciated that the duct of each body section can be filled by simply passing grout through a grout vent of one end of apparatus 10.

To facilitate grout being inserted through grout vent GV, grout vent GV' at an opposite end of apparatus 10 can be allowed to remain open or unplugged to allow air to be forced out by the injected grout. Leaving such an opposite end grout vent open also allows a user to determine when apparatus 10 is full of grout to a desired extent since grout being injected into apparatus 10 will ultimately exit the opposite end grout vent. At this point, the opposite end grout vent can be plugged as well as can be the grout vent used to introduce the grout to apparatus 10, and the grout can be allowed to cure in order to bond the strands of each body section in place.

It is therefore seen that the present invention provides a novel post-tensioning apparatus and method. It is also seen that the present invention provides a post-tensioning apparatus and method which advantageously enables the passage of grout therethrough to bond strands therein without requiring or using grout vents exposed to and/or through the upper or lower surfaces of a concrete structure in which the apparatus is located. Additionally, it can be seen that the present invention provides a post-tensioning apparatus and method utilizing a grasping type fit between the ducts and the intermediate and end anchorage assemblies for a strong and reliable seal.

It will be understood that various details of the invention may be changed without departing from the scope of the invention. Furthermore, the foregoing description is for the purpose of illustration only, and not for the purpose of limitation, as the invention is defined by the following, appended claims.

What is claimed is:

1. A post-tensioning apparatus for a concrete structure, said apparatus comprising:

(a) at least a first and second body section interconnected in series by an intermediate anchor head with each body section having an end anchor head, each body section comprising a tendon including a pair of strands adapted for post-tensioning between said intermediate anchor head and a corresponding end anchor head with one end of each pair of strands being connected to said intermediate anchor head and an opposite end of each pair of strands being connected to said corresponding end anchor head, each pair of strands being encapsulated between said intermediate anchor head and said corresponding end anchor head in a duct defined by one or more duct sections, each duct adapted to receive a bonding agent after post-tensioning of said pair of strands therein to bond said pair of strands in position within said duct;

(b) passage means proximate said end anchor head of said first body section and providing a passage for insertion of bonding agent into said duct of said first body section; and (c) transfer means providing a passage for bonding agent in said duct of said first body section to pass past said intermediate anchor head into said duct of said second body section;

(d) whereby said ducts of said body sections are fillable with bonding agent to bond said strands therein by mere passage of bonding agent through said passage means and said transfer means.

2. The post-tensioning apparatus of claim 1 wherein said intermediate anchor head and said transfer means are part of an intermediate anchorage assembly which also comprises a trumpet portion and a bearing plate assembly fitted against opposite ends of said intermediate anchor head which each define passages therethrough that form a part of said ducts of each body section, and wherein said transfer means extends from said trumpet portion to said bearing plate assembly.

3. The post-tensioning apparatus of claim 2 wherein at least one of said end anchor heads and said passage means are part of an end anchorage assembly which also includes a bearing plate assembly fitted against said end anchor head and which defines a passage therethrough that forms a part of said duct of at least one of said body sections, and wherein said bearing plate assembly defines said passage means.

4. The post-tensioning apparatus of claim 1 wherein said intermediate anchor head encapsulates said strands attached thereto whereby said strands are fully encapsulated between each of said end anchor heads.

5. The post-tensioning apparatus of claim 1 wherein said bonding agent which each duct is adapted to receive comprises grout.

6. The post-tensioning apparatus of claim 1 wherein said one or more duct sections of each body section comprise plastic.

7. The post-tensioning apparatus of claim 1 wherein said passage means comprises a passage defined by one of said one or more duct sections.

8. The post-tensioning apparatus of claim 1 wherein said transfer means comprises a tube connected to at least one of said one or more duct sections of each body section with said intermediate anchor head positioned therebetween.

9. The post-tensioning apparatus of claim 1 wherein said pair of strands of each body section are spaced-apart and substantially parallel within said duct of each body section.

10. The post-tensioning apparatus of claim 1 wherein each strand is attached at each end thereof to a wedge member and wherein said intermediate anchor head defines apertures therethrough for receiving and maintaining said wedge members in position while each strand is tensioned.

11. The post-tensioning apparatus of claim 1 wherein each pair of strands is tensioned.

12. The post-tensioning apparatus of claim 11 wherein said duct of each body section is filled with bonding agent to bond each pair of strands.

13. The post-tensioning apparatus of claim 12 wherein said bonding agent is grout.

14. The post-tensioning apparatus of claim 1 wherein a liquid impervious seal exists between said one or more duct sections and each of said intermediate anchor head and end anchor heads.

15. The post-tensioning apparatus of claim 14 wherein a liquid impervious seal is provided between each of said one or more duct sections to protect each pair of strands from liquid.

16. The post-tensioning apparatus of claim 1 wherein each strand comprises a plurality of wires.

17. The post-tensioning apparatus of claim 16 wherein said wires of each strand are twisted and wherein said wires are metal.

18. The post-tensioning apparatus of claim 1 wherein said post-tensioning apparatus is extendingly positioned within a concrete slab.

19. The post-tensioning apparatus of claim 18 wherein said post-tensioning apparatus is extendingly positioned within said concrete slab such that said apparatus is exposed only at on at least one of said opposing ends of said slab.

20. The post-tensioning apparatus of claim 1 wherein (a) said intermediate anchor head and said transfer means are part of an intermediate anchorage assembly and each of said end anchor heads are part of separate end anchorage assemblies;

(b) said intermediate anchorage assembly also comprises a trumpet portion and a bearing plate assembly fitted against opposite ends of said intermediate anchor head and each of said end anchorage assemblies also comprises a bearing plate assembly fitted against an end of said end anchor;

(c) said intermediate anchorage assembly is separated from each of said end anchorage assemblies by first and second duct sections communicating therewith; and (d) said first and second duct sections are each mechanically interlocked to said intermediate anchorage assembly and one of said end anchorage assemblies so as not to be slidably removable therefrom.

21. The post-tensioning apparatus of claim 20 wherein separate half-shell assemblies are fitted over ribbed portions of said first and second duct sections and ribbed portions of said end anchorage assemblies and said intermediate anchorage assembly to interlock each of said first and second duct sections to said intermediate anchorage assembly and one of said end anchorage assemblies.

22. A post-tensioning apparatus for a concrete structure, said apparatus comprising:

(a) at least a first and second body section interconnected in series by an intermediate anchor head with each body section having an end anchor head, each body section comprising a tendon including a pair of strands consisting of a plurality of twisted wires adapted for post-tensioning between said intermediate anchor head and a corresponding end anchor head with one end of each pair of strands being connected to said intermediate anchor head and an opposite end of each pair of strands being connected to said corresponding end anchor head, each pair of strands being encapsulated between said intermediate anchor head and said corresponding end anchor head in a duct defined by one or more duct sections, each duct adapted to receive a bonding agent after post-tensioning of said pair of strands therein to bond said pair of strands in position within said duct;

(b) passage means defined by a duct section of at least one of said body sections proximate one of said end anchor heads wherein said passage means provides a passage for insertion of grout into said duct of said at least one body section; and (c) a tube connected to at least one duct section of each of said body sections, said tube communicating with said duct of each body section and providing a passage for grout in said duct of one of said body sections to pass past said intermediate anchor head and into a duct of said other of said body sections;

(d) whereby said ducts in which each pair of strands is encapsulated are fillable with grout by passage of grout only through said passage means and said tube.

23. A method of filling a post-tensioning apparatus for a concrete structure with a bonding agent, said method comprising the steps of:

(a) providing a post-tensioning apparatus for a concrete structure comprising:

(i) at least a first and second body section interconnected in series by an intermediate anchor head with each body section having an end anchor head, each body section comprising a tendon including a pair of strands consisting of a plurality of twisted wires adapted for post-tensioning between said intermediate anchor head and a corresponding end anchor head with one end of each pair of strands being connected to said intermediate anchor head and an opposite end of each pair of strands being connected to said corresponding end anchor head, each pair of strands being encapsulated between said intermediate anchor head and said corresponding end anchor head in a duct defined by one or more duct sections;

(ii) passage means on at least one of said first and second body sections; and (iii) transfer means providing a passage for bonding agent in said duct of one of said first and second body sections to pass past said intermediate anchor head into said duct of the other of said first and second body sections;

(b) injecting a bonding agent into said passage means to fill said duct of one of said first and second body sections and at least substantially surround said pair of strands therein; and (c) continuing to inject said bonding agent into said passage means to force said bonding agent from said duct of said one of said first and second body sections through said transfer means and into said duct of said other of said first and second body sections where said bonding agent fills said duct of said other of said first and second body sections and at least substantially surrounds said pair of strands therein.

24. The method of claim 23 wherein said bonding agent is grout.

25. The method of claim 23 further comprising an initial step of tensioning each pair of strands.

26. The method of claim 23 further comprising a last step of allowing said bonding agent to dry whereupon each pair of strands is bonded within its corresponding duct.

27. A method of pre-stressing a post-tensioning apparatus for a concrete structure, said method comprising the steps of:

(a) providing a post-tensioning apparatus for a concrete structure comprising:

(i) at least a first and second body section interconnected in series by an intermediate anchor head with each body section having an end anchor head, each body section comprising a tendon including a pair of strands adapted for post-tensioning between said intermediate anchor head and a corresponding end anchor head with one end of each pair of strands being connected to said intermediate anchor head and an opposite end of each pair of strands being connected to said corresponding end anchor head, each pair of strands being encapsulated between said intermediate anchor head and said corresponding end anchor head in a duct defined by one or more duct sections;

(ii) passage means proximate said end anchor head of said first body section and providing a passage for insertion of bonding agent into said duct of said first body section; and (iii) transfer means providing a passage for bonding agent in said duct of said first body section to pass past said intermediate anchor head into said duct of said second body section;

(iv) whereby said ducts in which said pairs of strands are encapsulated is filled with bonding agent by passage of bonding agent through said passage means and said transfer means;

(b) tensioning each pair of strands;

(c) injecting grout as said bonding agent into said passage means to fill one of said ducts and surround said pair of strands therein;

(d) continuing to inject said grout into said passage means to force said grout through said transfer means and into said other duct where it fills said other duct and surrounds said pair of strands therein; and (e) allowing said grout to cure whereupon each pair of strands becomes bonded within its respective duct.

28. The method of claim 27 wherein said steps occur while said post-tensioning apparatus is at least substantially positioned within a concrete slab to pre-stress said concrete slab.

* * * * *